US005748156A

United States Patent [19]

Weber

[11] Patent Number: 5,748,156

[45] Date of Patent: May 5, 1998

[54] HIGH-PERFORMANCE ANTENNA STRUCTURE

[75] Inventor: John G. Weber, Boulder Creek, Calif.

[73] Assignee: Chaparral Communications, San Jose, Calif.

[21] Appl. No.: 649,928

[22] Filed: May 16, 1996

Related U.S. Application Data

[63] Continuation of Ser. No. 420,909, Apr. 11, 1995, abandoned, which is a continuation of Ser. No. 203,442, Feb. 28, 1994, abandoned.

[51] Int. Cl.[6] ..... H01Q 3/00

[52] U.S. Cl. ..... 343/762; 343/763; 343/791; 343/821; 343/792

[58] Field of Search ..... 343/761, 763, 343/766, 786, 789, 790, 791, 820, 821, 822, 863, 864, 792, 762; 333/21 A; H01Q 13/02, 3/00

[56] References Cited

U.S. PATENT DOCUMENTS

| | | | |
|---|---|---|---|
| 2,407,057 | 9/1946 | Carter | 343/821 X |
| 2,412,867 | 12/1946 | Briggs et al. | 343/761 |
| 2,478,313 | 9/1949 | Peterson | 343/821 |
| 2,491,493 | 12/1949 | Goldberg | 343/761 X |
| 2,509,283 | 5/1950 | Wolf | 343/792 |
| 2,542,844 | 2/1951 | Smith | 343/864 X |
| 2,552,146 | 5/1951 | Brown | 343/821 X |
| 3,230,534 | 1/1966 | Luke et al. | 343/821 X |
| 4,109,254 | 8/1978 | Wolosczuk | 343/840 X |
| 4,504,836 | 3/1985 | Seavey | 343/797 X |
| 4,841,261 | 6/1989 | Augustin | 343/763 X |
| 4,940,989 | 7/1990 | Austin | 343/792 |
| 5,103,237 | 4/1992 | Weber | 343/786 |
| 5,248,988 | 9/1993 | Makino | 343/790 |
| 5,392,055 | 2/1995 | Madnick et al. | 343/790 |

*Primary Examiner*—Donald T. Hajec
*Assistant Examiner*—Tan Ho
*Attorney, Agent, or Firm*—William E. Pelton

[57] ABSTRACT

An antenna structure has a rotatable dipole array constituting a driven antenna element, a cup mounted around the dipole, a first conductor connected to and extending from the antenna, and a first dielectric mounted around the first conductor. A second conductor is mounted around the first dielectric, and a second dielectric is mounted around the second conductor. A third conductor is mounted around the second dielectric, and the first and second conductors form a quarter-wavelength transformer. The first dielectric maintains a uniform spacing between the first and second conductors, and the third conductor defines a radio-frequency coupling cavity. The second dielectric electrically enlarges the cavity. Thus the physical dimensions of the structure can be reduced without sacrifice of its electrical properties.

7 Claims, 3 Drawing Sheets

HIGH-PERFORMANCE ANTENNA STRUCTURE

This is a continuation of application Ser. No. 08/420,909, filed Apr. 11, 1995 and Ser. No. 08/203,442, filed Feb. 28, 1994, both now abandoned.

BACKGROUND OF THE INVENTION

1. Field of the Invention

This invention relates to antenna structures and, more particularly, to a novel and highly effective antenna structure for illuminating a paraboloid reflector and having selective polarization. The physical dimensions of the antenna structure of this invention are reduced without sacrifice of its electrical properties.

2. Description of the Prior Art

As used herein, the term "antenna structure" includes the electrically driven antenna element, which may for example constitute a dipole, and associated structure for determining the radiation pattern of the antenna. The associated structure could include, by way of example, a broadband cup mounted around the dipole and suitable feed structure including a rotary joint constructed in part from a radio-frequency coaxial coupling cavity together with conductor elements which define a suitable transformer electrically connected to the driven elements of the antenna. Other structure defining the physical environment in which the present antenna is designed to function may also be included as necessary.

Many antenna structures are known. Examples include the following:

A patent to Faflick U.S. Pat. No. 2,946,055 discloses a circularly polarized antenna system including a conductive plate having a rectangular aperture therein, a rectangular waveguide connected to the plate behind the aperture and open at the aperture, and a dipole disposed in the plane of the aperture and tilted relative to the longer axis of the aperture. A short-circuited quarter-wavelength transmission line is connected to the dipole and extends into the waveguide.

A patent to Wheeler U.S. Pat. No. 3,680,138 discloses a circular aperture waveguide emitting element of cross section comparable with the emitted wavelengths. The waveguide has a linear polarization output due to a cross-mode reflector which is a resonant bar mounted on a window located in the aperture.

A patent to Kumpebeck U.S. Pat. No. 3,922,683 discloses an antenna for radiating wave energy signals in three frequency bands. Signals having frequencies in the first and third bands are radiated by a first radiator. The signals having frequencies in the second, intermediate frequency band are radiated by a second radiator. The impedance characteristics of the radiators are used selectively to couple signals from the input to the appropriate radiator.

A patent to Woloszczuk U.S. Pat. No. 4,109,254 discloses a dipole radiator for feeding a parabolic reflector. A half-wave dipole is arranged at the mouth of a shallow cavity. The cavity is preferably circular with a diameter approximately three times its depth. In the case of a linearly polarized radiator, a cylindrical cavity is provided having a diameter of 0.72λ and a height of 0.26λ, and the half-wave dipole element is positioned 0.26λ above the base of the cavity so that the dipole element extends beyond the cavity. In a circularly polarized radiator, two crossed half-wave dipole elements are provided, one of which is inductive and the other of which is capacitive. The cylindrical cavity has a diameter of 0.66λ and a height of 0.28λ and the crossed dipole elements are positioned 0.22λ above the base of the cavity so as to lie flush with the mouth of the cavity.

A patent to Ellis, Jr. U.S. Pat. No. 4,218,685 discloses a coaxial antenna array for transmitting and receiving circularly polarized electromagnetic radiation. Open ended antenna cavities are coaxially constructed and operate by excitation of linear radiation elements arranged within each of the cavities. A pair of crossed-dipole radiation devices are centered within the inner cavity and operated by means of a phase-shifting network circuit to transmit as well as receive circularly polarized radiation. Four monopole radiation devices are symmetrically arranged to operate in the outer cavity in phase quadrature by means of the phase-shifting network circuit to also both transmit and receive circularly polarized electromagnetic radiation. Combined operation of the two antenna cavities with a 180° phase differential between the fields related to the two antenna cavities provides a broad beam, relatively wide frequency bandwidth communication capability. Particular embodiments disclosed include a generally square cavity array as well as a circular cavity array.

A patent to Bowman U.S. Pat. No. 4,513,292 discloses a one-piece array antenna dipole radiating element formed from a wide, thin conductor. This element is suitable for attachment to a microstrip or other feed circuit. The radiation element includes a dipole portion, a balanced transmission line portion and a balun portion. These various portions are formed by providing an appropriately shaped slot in the thin conductor.

A patent to Mahnad U.S. Pat. No. 4,668,956 discloses a broadband cup antenna having a dipole formed with a pair of short spiral monopoles diametrically disposed in a common plane in proximity to the open end of the cup. Parasitic elements are in juxtaposition with the monopoles and are electrically connected by a conductive ring mounted about coaxial lines. A circumferential slot formed in the outer conductor of the coaxial line adjacent to the monopoles serves for excitation of the monopole elements to effectuate signal transmission.

A patent to Seavey U.S. Pat. No. 4,504,836 discloses a circular waveguide opening coupled to a small dipole radiator. The dipole is arranged to rotate about its axis by means of an extension of its inner conductor. The inner conductor of the dipole extends into a rectangular waveguide where in engages a dielectric drive shaft. The inner conductor excites the rectangular waveguide in a conventional fashion.

These various documents and other similar ones disclose many different antennas and associated structures, including antenna structures suitable for transmitting and receiving signals of different polarizations. The structures of the prior art have, however, certain drawbacks. One such drawback is that the prior structures have relied primarily on waveguide transmission of received signals. Waveguide structures have been found to be larger and costlier then they ideally should be. While such structures have heretofore enjoyed substantial commercial success, they have nevertheless been found to be relatively expensive to manufacture, to ship, and to warehouse.

This has been found to be the case even though waveguide antenna structures are made largely of conductive materials such as aluminum. Aluminum offers a good compromise between adequate conductivity and acceptable cost. While the cost of aluminum makes it "acceptable" for use in manufacturing antenna structures, aluminum is not especially cheap. It would be very desirable, therefore, to find a way of reducing the amount of aluminum employed in such structures without sacrifice of the electrical properties. A reduction in the amount of aluminum employed will of course reduce the cost of the materials. To the extent that the weight and volume of the resulting antenna structure are reduced, shipping and storage costs are also reduced.

While a reduction in cost is important, particularly in high-volume items such as antenna structures that are sold in a competitive environment, it is important not to sacrifice the electrical properties of the antenna structure. Goods can generally be made less expensive at the cost of degraded performance; what is needed is to reduce costs without degrading performance.

OBJECTS AND SUMMARY OF THE INVENTION

An object of the invention is to remedy the problems of the prior art outlined above. In particular, an object of the invention is to provide an antenna structure that is less expensive than similar conventional structures but that functions equally well.

Another object of the invention is to provide an improved antenna structure whereof the antenna proper comprises a dipole that can be rotated to receive and transmit electromagnetic signals having different polarizations.

Still another object of the invention is to provide an improved antenna structure which includes the antenna and integrated pre-amplifier circuitry in a single, low cost housing of relatively small dimensions.

A further object of the invention is to provide a novel type of rotary joint for feeding a rotatable element of an antenna structure.

The foregoing and other objects are attained in accordance with the invention by providing antenna structure having inner and outer coaxial feed lines for driving a rotatable electrically driven antenna element. In one embodiment, the antenna structure comprises an antenna, a first conductor connected to and extending from the antenna, and a first dielectric mounted around the first conductor. A second conductor is mounted around the first dielectric, and a second dielectric is mounted around the second conductor. A third conductor is mounted around the second dielectric, and the first and second conductors form a quarter-wavelength transformer. The first dielectric maintains a uniform spacing between the first and second conductors. The third conductor defines a radio-frequency coupling cavity, and the second dielectric electrically enlarges the cavity. Thus the physical dimensions of the structure can be reduced without sacrifice of its electrical properties.

In the preferred embodiments the antenna is a dipole, and a cup is provided having a conductive rear wall, a conductive side wall and an open front. The cup is mounted around the dipole, and the dipole and cup form a cup antenna having a substantially rotationally symmetrical radiation pattern. The rear wall of the cup is formed with an opening, and the first conductor extends through the opening. The first dielectric also extends through the opening and insulates the first conductor from the cup. In one embodiment, the first dielectric rotatably engages the dipole structure and the first conductor to enable the dipole selectively to receive and transmit signals of different polarizations. A servomotor engages the first dielectric for rotating the first dielectric.

BRIEF DESCRIPTION OF THE DRAWING

A better understanding of the objects, features and advantages of the invention can be gained from a consideration of the following detailed description of the preferred embodiment thereof, in conjunction with the appended figures of the drawing, wherein.

DESCRIPTION OF THE PREFERRED EMBODIMENTS

Figure 1:
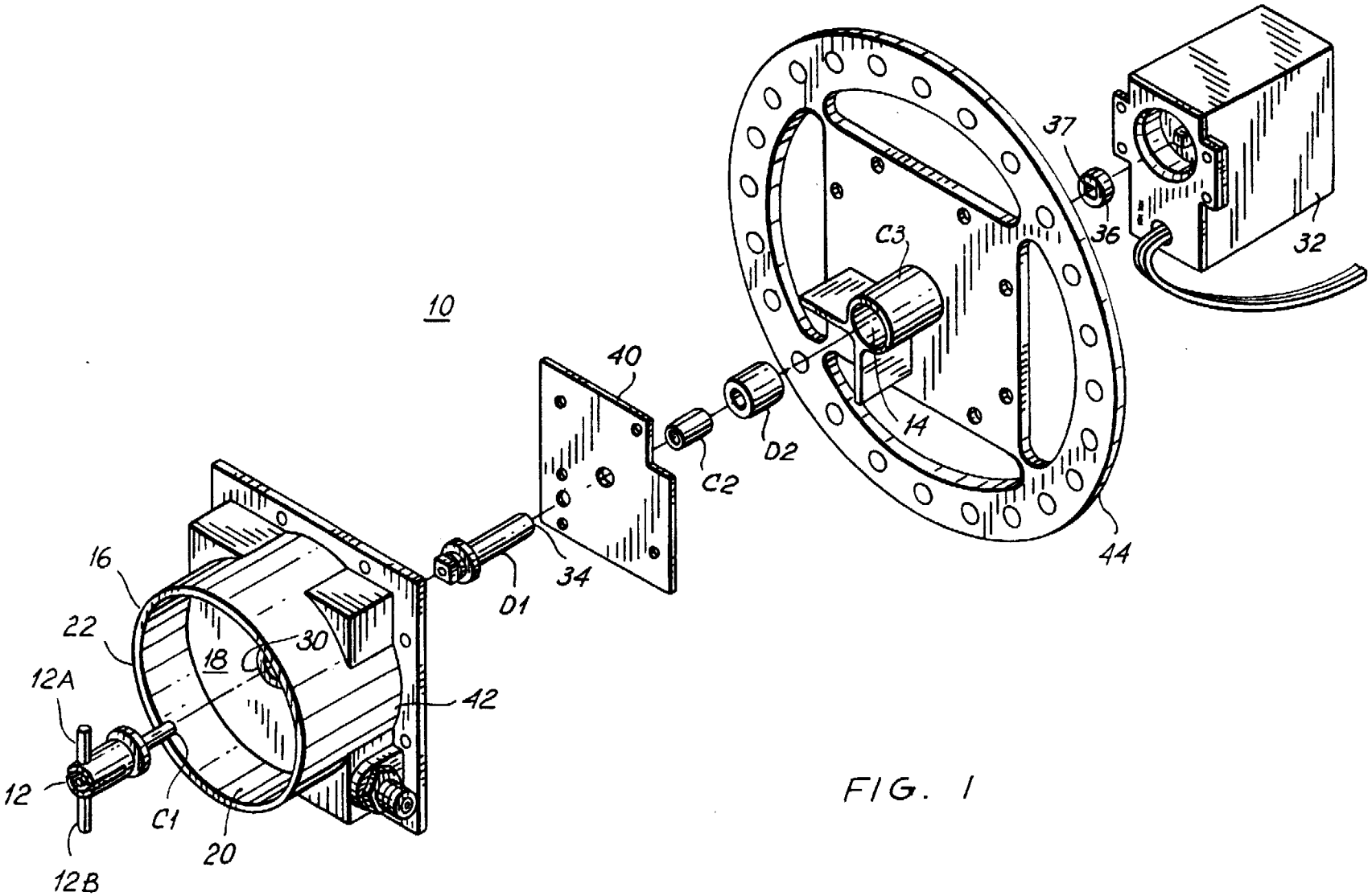
FIG. 1 is an exploded perspective view of a preferred embodiment of apparatus constructed in accordance with the invention.

Referring now to the drawings, and in particular to FIG. 1, there is shown apparatus 10 constructed in accordance with one embodiment of the invention. The apparatus 10 consists of an antenna structure comprising a driven dipole array 12, a first conductor C1 connected to and extending from the element 12, and a first dielectric D1 mounted around the first conductor C1. A second conductor C2 is mounted around the first dielectric D1, and a second dielectric D2 is mounted around the second conductor C2. A third conductor C3 is mounted around the second dielectric D2.

The length of C2 is preferably about one quarter wavelength at the frequency band of interest. The first dielectric D1 maintains a uniform spacing between the first and second conductors C1, C2.

The third conductor C3 defines a radio-frequency coupling cavity 14, and the second dielectric D2 electrically enlarges the cavity 14. Thus the length of the cavity 14 and the resulting physical dimensions of the entire structure 10 can be reduced without sacrifice of its electrical properties. That is, without the electrical enlargement of the cavity 14 effected by the second dielectric D2, the third conductor C3 must be longer in order to achieve the same electrical performance. This means more metal (typically aluminum) would otherwise be employed resulting in a structure that is larger, heavier and more expensive.

Figure 2:
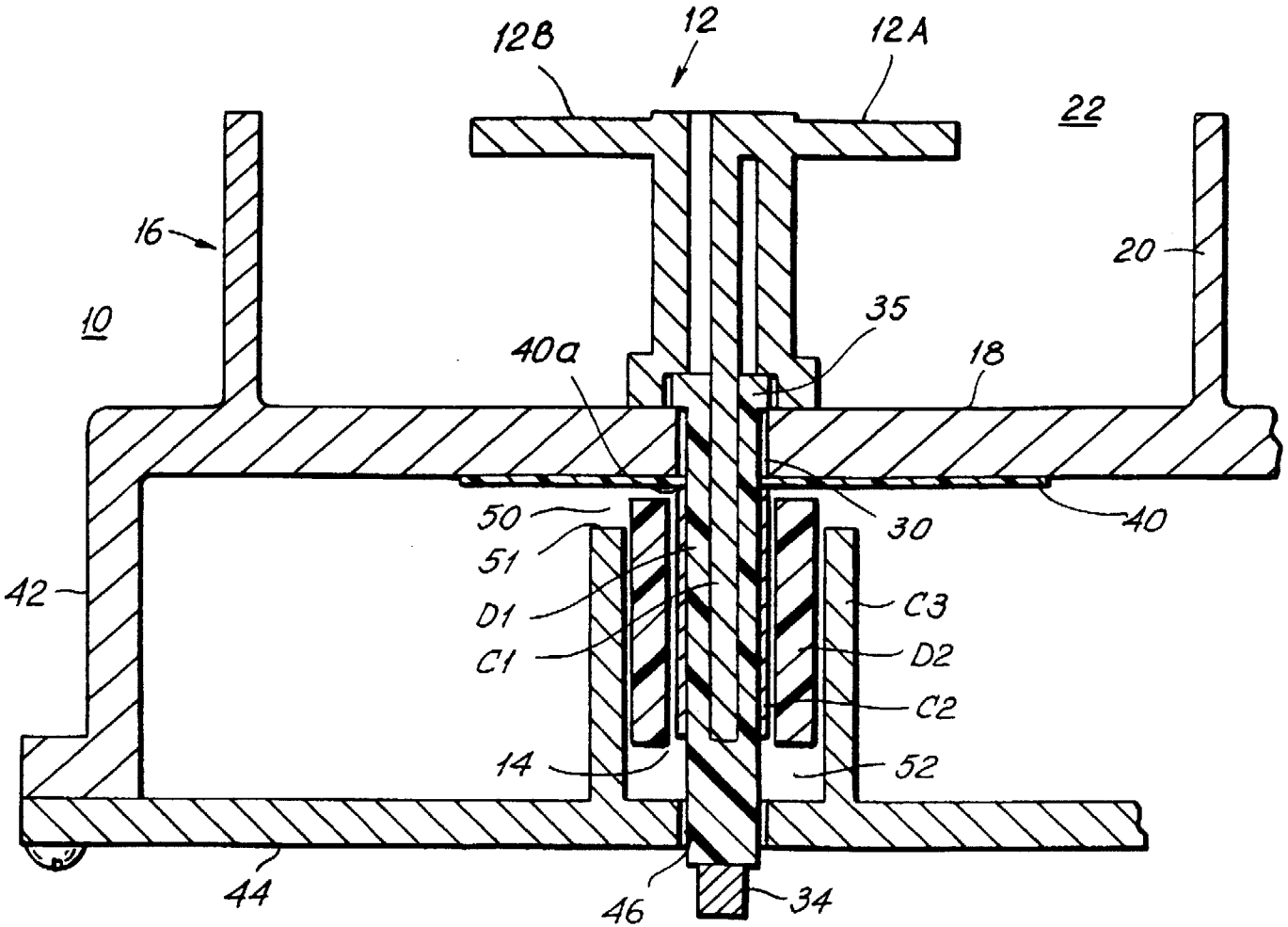
FIG. 2 is a longitudinal sectional view of a second, though similar, embodiment of the type of device shown in FIG. 1, but showing the antenna in an assembled state.

Preferably the antenna 12 comprises a dipole, as illustrated in FIGS. 1 and 2. The dipole includes a driven element **12*a* and a parasitic element 12*b*. The conductor C1 is electrically connected to the driven element 12*a*, as seen best in FIG. 2. The structure also preferably comprises a cup 16 having a conductive rear wall 18, a conductive side wall 20 and an open front defining an aperture 22. The cup 16 is mounted around the dipole 12, and the dipole 12 and cup 16 form a cup antenna. The cup antenna can be for example a broadband cup antenna of the type disclosed in the '956 patent to Mahnad mentioned above. Alternatively, the antenna structure may employ a waveguide of circular or other cross section, and having rotatable probe excitation, or a rotatable dipole or turnstile over a ground plane, all of which has been in common use in TVRO C-band or Ku-band satellite reception. The type of radiating element employed is not critical to the invention. In the present embodiment, the plane containing the dipole elements 12*a* and 12*b* substantially coincides with the aperture plane of the cup 16. However, the location of the dipole array relative to its resonant cup 16** has not been found to be critical and any configuration may be selected which affords the desired radiation pattern.

The rear wall 18 of the cup 16 is formed with a central bore or opening 30, and the conductor C1 extends through the opening 30. The first dielectric D1 also extends through the opening 30 and insulators the first conductor C1 from the cup 16 and particularly from the rear wall 18 thereof. The dielectric D1 also acts as a mechanical bearing within the opening 30.

The first dielectric D1 preferably engages the first conductor C1 in a friction or other fit so that there is no relative movement between them. The dielectric may have an elongated hole formed longitudinally therein to receive the conductor C1 for this purpose. Other fastening techniques may be utilized as will be recognized by those skilled in the art. Rotation of the dielectric D1 therefore serves to rotate the first conductor C1 and the dipole array 12, thereby enabling the dipole 12 selectively to receive and transmit signals of different polarizations. A servomotor 32 (FIG. 1) engages the distal end 34 of the first dielectric D1 to rotate the first dielectric D1 and thereby rotate the first conductor C1 and the dipole 12. The distal end 34 of the dielectric D1 may be round or squared off or otherwise configured to engage the drive shaft of the servomotor. An intermediate connecting sleeve 36 with square bore 37 therein may be used, as shown in FIG. 1. The servomotor 32 is controlled in any conventional manner, as those skilled in the art will readily understand. From a remote position, it is therefore easily possible to reorient the dipole 12 to receive or transmit electromagnetic radiation polarized in the vertical or horizontal plane, or signals that are elliptically (preferably circularly) polarized clockwise or counterclockwise. This renders the antenna structure will suited for example to receive signals of different polarizations broadcast by a satellite in geostationary orbit.

Figure 3:
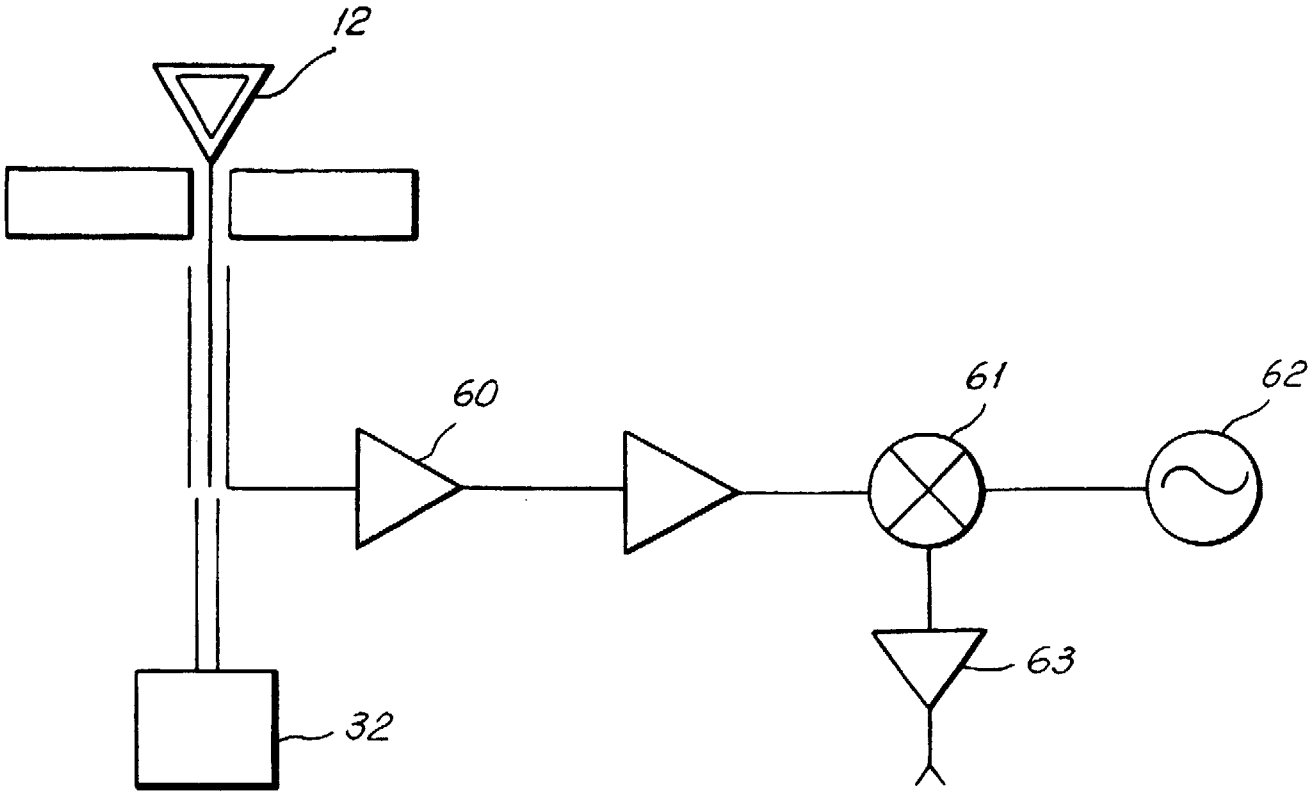
FIG. 3 is a schematic system view of one embodiment of the invention showing signal processing circuitry.

As shown in FIG. 2, a printed circuit board 40 may be mounted behind the cup 16 within a housing 42 defined by the same casting in which the cup 16 is formed. In this embodiment, a combined housing cover and universal mounting plate 44 covers the end of the housing 42 opposite the dipole array 12. A hole 46 is formed in the cover and mounting plate 44, and the first dielectric D1 extends through the hole 46 so that the distal end 34 can be suitably engaged and rotated by the servomotor 32. As shown in FIG. 3, signal processing circuits including a low noise amplifier, mixer, oscillator and intermediate frequency amplifier may be formed on the printed circuit board 40 within the housing 42 and connected to the feed line for the dipole array. The attendant signal processing circuits are well understood by those skilled in the art and need not be explained in detail herein. As indicated much of the required electrical processing circuitry can easily be incorporated in the printed circuit board 40, as those skilled in the art will readily understand.

The feed line for the dipole array is formed in part by the conductor C2 which preferably is electrically connected via an annular connection 40*a* to a microstrip line formed on the printed circuit board 40. Inherently the annular connection 40*a* produces a shunt capacitance to ground and the microstrip line connecting the annular connection to the input gate (not shown) to the printed circuit board produces an inductance. In the preferred embodiment, the conductor C2 is a cylinder and it is fixed relative to the dielectric D1 and does not turn therewith. In the preferred embodiment, C3 is a cylindrical sleeve of predetermined length, preferably substantially one quarter wavelength at the frequency of interest, and it terminates at an air gap 50 defined between its free end 51 and the back of the plate defining the back wall 18 of the cup 16. The conductor sleeve C2 which also has a preferred length of substantially one quarter wavelength at the frequency of interest terminates short of the plate 44 defining a second air gap 52. As shown in FIG. 2, C2 is the inner conductor for the outer conductor C3 in the assembled unit and together with C3 defines a coaxial transmission line for signals fed to the dipole array from the processing circuitry formed on the printed circuit board 40. At the same time, C2 is the outer conductor for the inner conductor C1. Considered together, C1, C2 and C3 define a rotary joint defined by a coaxial unbalanced transmission line for feeding the dipole array.

The dipole array 12, including the driven element 12*a* and the parasitic element 12*b*, are coupled to the unbalanced 50-ohm coaxial transmission line defined by C1, C2 and C3 line with a balun, as is conventional per se and readily obtainable from commercial sources. As indicated elsewhere herein, the invention is not limited to any particular type of radiating element, although it is certainly very well adapted for use with the dipole array 12 illustrated in the figures of the accompanying drawing.

As shown in FIG. 2, the annular space between the outermost conductor C3 and its inner conductor C2 is a physically small, dielectrically loaded cavity 14. Selection of the dielectric constant of the loading material employed for the second dielectric D2 controls the resonating frequency and physical length of the cavity 14. The best frequency band for efficient transmission of power may be selected at the smallest physical size for the loaded cavity 14. Energy is removed from the cavity through the quarter-wavelength conductor C2 and is supplied to a low noise block system for amplification and down-conversion which may be incorporated in the printed circuit board 40, as described above. In conventional structure, a radio-frequency coupling cavity with air dielectric, for example, must be relatively large in order to be tuned to the desired frequency. This requires the use of a relatively large amount of aluminum, which adds to the cost of materials and to the shipping weight. In some structures, it also adds to the volume. In accordance with the invention, the cost of materials, weight, and volume are as small as possible without sacrifice of the desired electrical properties.

Thus there is provided in accordance with the invention a novel and highly effective antenna structure that avoids the problems of the prior art and accomplishes the objects of the present invention as set out above. Many modifications of the preferred embodiment of the invention disclosed above will readily occur to those skilled in the art. For example, while aluminum is the preferred material for the several conductors, other conductors such as copper, even silver, etc., can be employed in principle. Also, any suitable plastic or other dielectric can be employed in accordance with the frequency band of interest. The invention is not limited by the particular type of antenna proper or by the electrical signal processing circuitry employed. Accordingly, the invention includes all structure that falls within the scope of the appended claims, plus equivalents thereof.

I claim:

1. Antenna structure comprising:

an antenna;

a first conductor connected to and extending from said antenna;

a first dielectric mounted around said first conductor;

a second conductor mounted around said first dielectric;

a second dielectric mounted around said second conductor; and a third conductor mounted around said second dielectric;

said first, second and third conductors being electrically insulated from one another;

said first and second conductors forming a first part of a coaxial transmission line;

said first dielectric maintaining a uniform spacing between said first and second conductors;

said second and third conductors defining a second part of said coaxial transmission line in series with said first part of said coaxial transmission line; and said second dielectric electrically enlarging said second part of said coaxial transmission line;

whereby the physical dimensions of said structure can be reduced without sacrifice of its electrical properties.

2. Structure according to claim 1 wherein said antenna comprises a dipole.

3. Structure according to claim 2 further comprising a cup having a conductive rear wall, a conductive side wall and an open front, said cup being mounted around said dipole and said dipole and cup forming a cup antenna.

4. Structure according to claim 3 wherein said rear wall is formed with an opening and said first conductor extends through said opening.

5. Structure according to claim 4 wherein said first dielectric extends through said opening and insulates said first conductor from said cup.

6. Structure according to claim 2 wherein said first dielectric engages said first conductor and is rotatable to rotate said first conductor and said dipole, thereby enabling said dipole selectively to receive and transmit signals of different polarizations.

7. Structure according to claim 6 further comprising a servomotor engageable with said first dielectric for rotating said first dielectric.

* * * * *